US010434566B2

(12) United States Patent
Hattori et al.

(10) Patent No.: US 10,434,566 B2
(45) Date of Patent: Oct. 8, 2019

(54) CASTING DEVICE

(71) Applicant: HONDA MOTOR CO., LTD., Minato-ku, Tokyo (JP)

(72) Inventors: Masayuki Hattori, Tochigi-ken (JP); Kenichi Shuto, Tochigi-ken (JP); Toshihiro Takahashi, Tochigi-ken (JP); Hiroshi Takahashi, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/084,625

(22) PCT Filed: Mar. 16, 2017

(86) PCT No.: PCT/JP2017/010790
§ 371 (c)(1),
(2) Date: Sep. 13, 2018

(87) PCT Pub. No.: WO2017/159824
PCT Pub. Date: Sep. 21, 2017

(65) Prior Publication Data

US 2019/0076917 A1 Mar. 14, 2019

(30) Foreign Application Priority Data

Mar. 18, 2016 (JP) ..... 2016-056056

(51) Int. Cl.
*B22C 9/06* (2006.01)
*B22C 9/10* (2006.01)
*B22D 17/22* (2006.01)

(52) U.S. Cl.
CPC ..... *B22C 9/062* (2013.01); *B22C 9/103* (2013.01); *B22D 17/2209* (2013.01)

(58) Field of Classification Search
CPC ..... B22C 9/06; B22C 9/062; B22C 9/064; B22C 9/10; B22C 9/103; B22D 17/22; B22D 17/24
See application file for complete search history.

(56) References Cited

U.S. PATENT DOCUMENTS 10,058,915 B2 * 8/2018 Uehara ..... B22D 17/22

FOREIGN PATENT DOCUMENTS

| | | | |
|---|---|---|---|
| GB | 1370896 A * 10/1974 | ..... | B22C 9/103 |
| JP | 69-044627 3/1984 | | |
| JP | 02-022111 6/1990 | | |

(Continued)

OTHER PUBLICATIONS

International Search Report and Written Opinion for International Application No. PCT/JP2017/010790 dated May 9, 2017, 6 pages.

*Primary Examiner* — Kevin E Yoon
(74) *Attorney, Agent, or Firm* — Amin, Turocy & Watson LLP

(57) ABSTRACT

A casting device is provided with: a pair of cylinders; a core pin holding member to which core pins are attached; and a pair of bent members. The cylinder is disposed in parallel with a second limb of the bent member, and a rod is coupled to a surface on the inner side of a first limb of the bent member. The second limb is coupled to the core pin holding member via a coupling mechanism so as to be freely attachable to/detachable from the core pin holding member.

8 Claims, 10 Drawing Sheets

(56) References Cited

FOREIGN PATENT DOCUMENTS

| | | |
|---|---|---|
| JP | 02-031230 | 8/1990 |
| JP | 05-092237 | 4/1993 |
| JP | 2003-326350 | 11/2003 |
| JP | 2005-066642 | 3/2005 |
| JP | 2012-096275 | 5/2012 |

* cited by examiner

CASTING DEVICE

TECHNICAL FIELD

The present invention relates to a casting device having a core pin movable for advancing and retracting in a product cavity, and casting molten metal into the product cavity to obtain a casting having a cast hole.

BACKGROUND ART

Generally, castings manufactured by a casting device are used for various machine components. For example, in a cylinder head constituting an internal combustion engine, a cast hole is formed for attaching a device such as an injector. Therefore, in a casting device for casting a cylinder head, a core pin is disposed movably for advancing and retracting in a product cavity.

For example, in a core accommodating casting device disclosed in Japanese Utility Model Publication No. 02-022111, a fixing frame is provided at a position surrounding the mold, and a hydraulic cylinder is attached to the fixing frame.

A piston rod extends from the hydraulic cylinder toward the mold, and the piston rod is connected to a central portion of the slide frame. A plurality of foundry cores are attached to the slide frame. The foundry cores project into the mold parallel to the piston rod and is arranged in a cavity in the mold under the action of the hydraulic cylinder.

SUMMARY OF INVENTION

However, in the above-described core accommodating casting device, since the advancing and retreating direction of the piston rod is the same direction as the advancing and retreating direction of the foundry core, the entire equipment including the hydraulic cylinder and the foundry core is undesirably elongated in the axial direction of the piston rod. Moreover, in order to reliably advance or retract the foundry core with a desired stroke, the hydraulic cylinder itself may be increased in size.

Furthermore, it is necessary to replace the core pin in response to the change in the type of the cylinder head. However, in the above-mentioned core accommodating casting device, the hydraulic cylinder is attached to the fixing frame surrounding the mold, and the piston rod projects into the fixing frame and is fixed to the slide frame. Therefore, there is a problem that core pin replacement operation becomes considerably complicated.

A main object of the present invention is to provide a casting device capable of reliably advancing and retracting a core pin with a compact and economical configuration.

Another object of the present invention is to provide a casting device capable of effectively simplifying the core pin replacement operation.

The present invention relates to a casting device having a core pin capable of advancing and retreating in a product cavity, wherein a molten metal is poured into the product cavity to obtain a cast product with a cast hole.

This casting device includes a pair of cylinders, a core pin holding member to which a core pin is attached, and a pair of bent members having a first side and a second side respectively extending in directions intersecting with each other. The cylinder is arranged in parallel with the second side and is arranged to face an inner surface of the first side. The rod projecting from the cylinder is connected to the inner surface of the first side and the second side is detachably connected to an end portion of the core pin holding member via a joint mechanism.

According to the present invention, the cylinder is arranged in parallel with the second side and is arranged to face the inner surface of the first side. Then, by moving a rod connected to the first side of the bent member forward and backward, the core pin holding member connected to the second side of the bent member advances and retracts within the cavity. Therefore, the dimension in the stroke length direction is effectively shortened, and the equipment can be made compact easily.

Moreover, the cylinder is offset from the joint mechanism. Accordingly, in a state in which the cylinder is attached, it is possible to easily detach the core pin holding member and the core pin. Thereby, it is possible to reliably advance and retreat the core pin with a compact and economical configuration and to effectively simplify the replacement operation of the core pin.

The joint mechanism may include a first opening formed in an end portion of the core pin holding member, a second opening formed in the second side, and a joint pin to be inserted into both the first opening and the second opening.

Further, the casting device is preferably provided with a restriction mechanism disposed on the bent member and restricting movement of the joint pin in the axial direction. The restriction mechanism preferably includes a screw hole formed in a second side of the bent member in a direction intersecting with the axial direction of the joint pin, a fixing screw member screwed into the screw hole, and an engaging recessed portion formed in the joint pin. It is preferable that the fixing screw member screwed into the screw hole is engaged with the engaging recessed portion so as to restrict the movement of the joint pin in the axial direction.

The engaging recessed portion is formed of, for example, an engagement groove formed so as to surround a sidewall of the joint pin. Alternatively, a step portion formed at an end of the joint pin may be used as the engaging recessed portion.

Still further, the casting device is preferably provided with a restriction mechanism provided on the bent member, for restricting movement of the joint pin in the axial direction. In this case, it is preferable that the restriction mechanism includes an engaging groove formed on the outer peripheral surface of the joint pin, and a locking plate engaged with the engaging groove and swingable.

In this casting device, it is preferable that the rod of the cylinder projects toward the first side, from the end opposite to the end on a leading side in the mold clamping direction.

Further, in this casting device, it is preferable that the bent member has an L shape whose first side is shorter than the second side.

DESCRIPTION OF EMBODIMENTS

Figure 1:
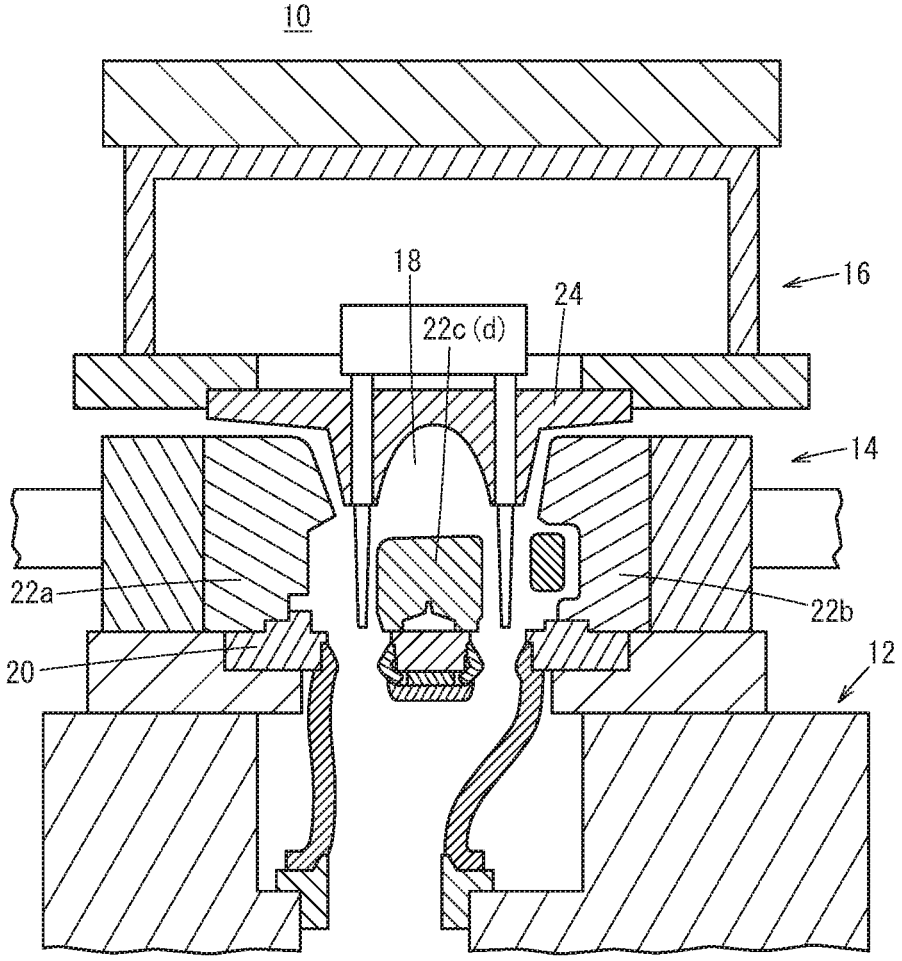
FIG. 1 is a schematic structural diagram of a casting device according to a first embodiment of the present invention.

As shown in FIG. 1, a casting device 10 according to a first embodiment of the present invention includes a lower mold base 12, a sliding mold base 14 and an upper mold base 16, and a product cavity 18 formed therein. The cavity 18 corresponds to a shape of a desired cast article such as a cylinder head and the like.

The lower mold 20 defining a lower side surface of the cavity 18 is held in the lower mold base 12. For example, four sliding molds 22*a*, 22*b*, 22*c*, and 22*d* defining side surfaces of the cavity 18 are held in the sliding mold base 14, and the sliding molds 22*a* to 22*d* are movable back and forth in the horizontal direction.

Figure 2:
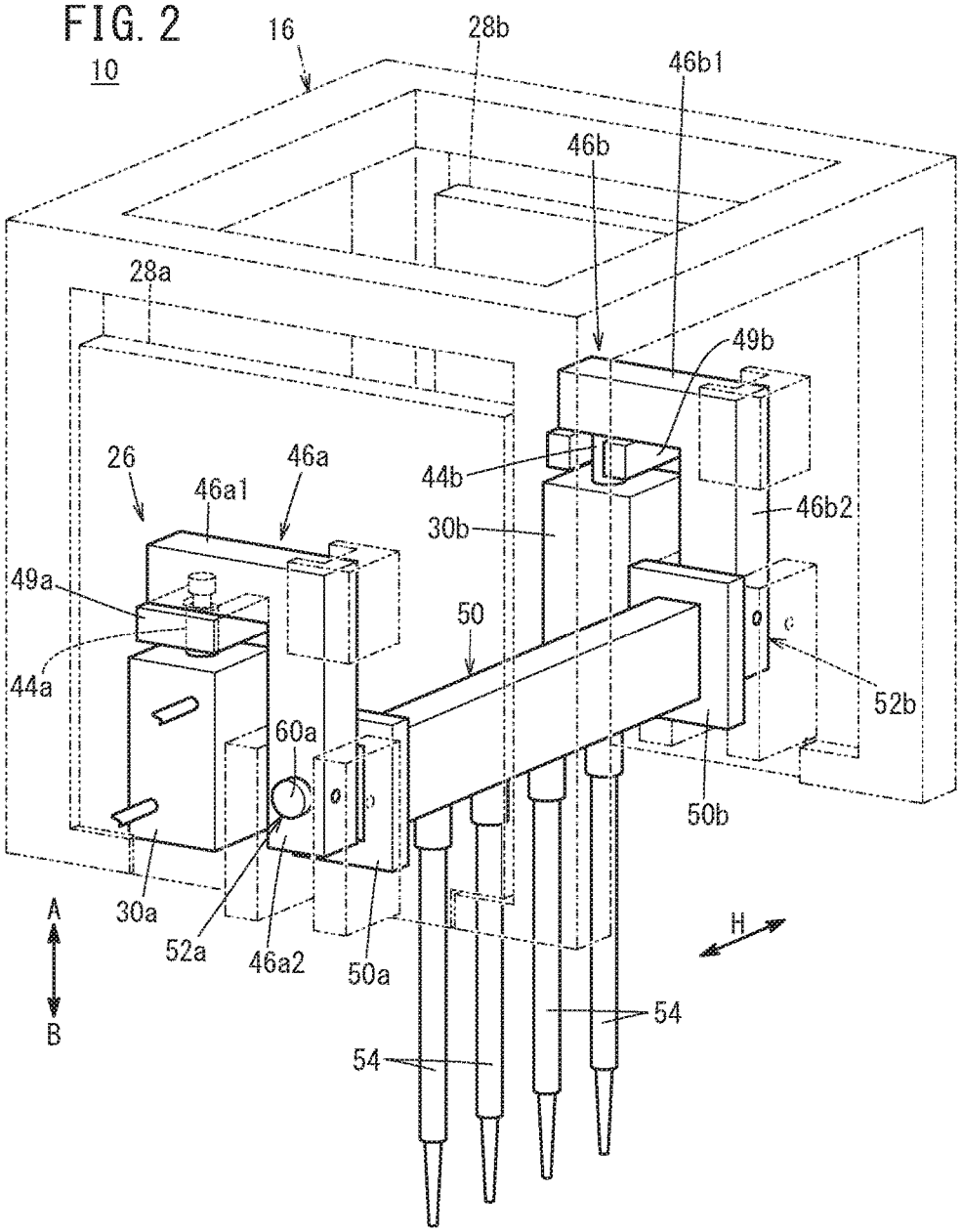
FIG. 2 is a perspective explanatory view of an upper mold base of the casting device.

An upper mold 24 defining an upper side surface of the cavity 18 is held in the upper mold base 16 and the upper mold 24 is movable forward and backward integrally with the upper mold base 16 in the vertical direction. As shown in FIG. 2, a core pin movable structure 26 is provided on the upper mold base 16.

The core pin movable structure 26 forms a pair of opposed side surfaces (surfaces on both sides in the direction of arrow H) of the upper mold base 16 and has a pair of cylinder mounting plates 28*a* and 28*b* removably attached to the upper mold base 16. The cylinders 30*a*, 30*b* are attached to the cylinder mounting plates 28*a*, 28*b*. The pair of cylinders 30*a* and 30*b* are preferably hydraulic cylinders.

Figure 3:
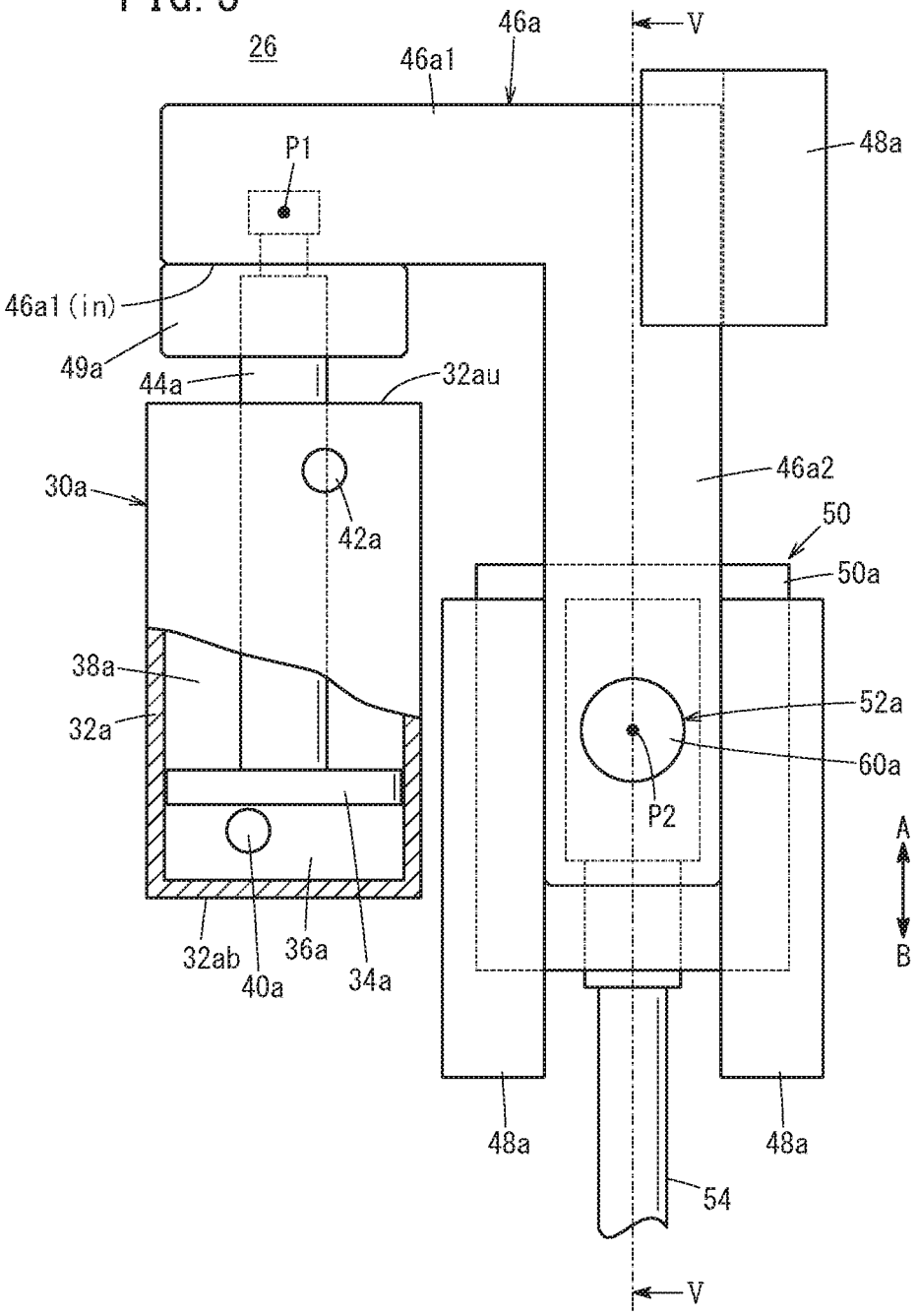
FIG. 3 is a front explanatory view of a core pin movable structure provided on the upper mold base.

As shown in FIG. 3, the cylinder 30*a* has a cylinder tube 32*a*, and a piston 34*a* is disposed in the cylinder tube 32*a* slidably in the vertical direction (in the direction of arrow A and in the direction of arrow B). The interior of the cylinder tube 32*a* is divided into a first pressure chamber 36*a* and a second pressure chamber 38*a* by a piston 34*a*. A first port 40*a* communicating with the first pressure chamber 36*a* and a second port 42*a* communicating with the second pressure chamber 38*a* are formed on the outer peripheral surface of the cylinder tube 32*a*.

One end of a rod (piston rod) 44*a* is connected to the upper surface of the piston 34*a*. The rod 44*a* extends upward and projects upward from the upper end portion of the cylinder tube 32*a*, that is, from the end portion 32*au* opposite to the end portion 32*ab* on the leading end side in the clamping direction. The rod 44*a* is connected to the bent member 46*a*.

Figure 4:
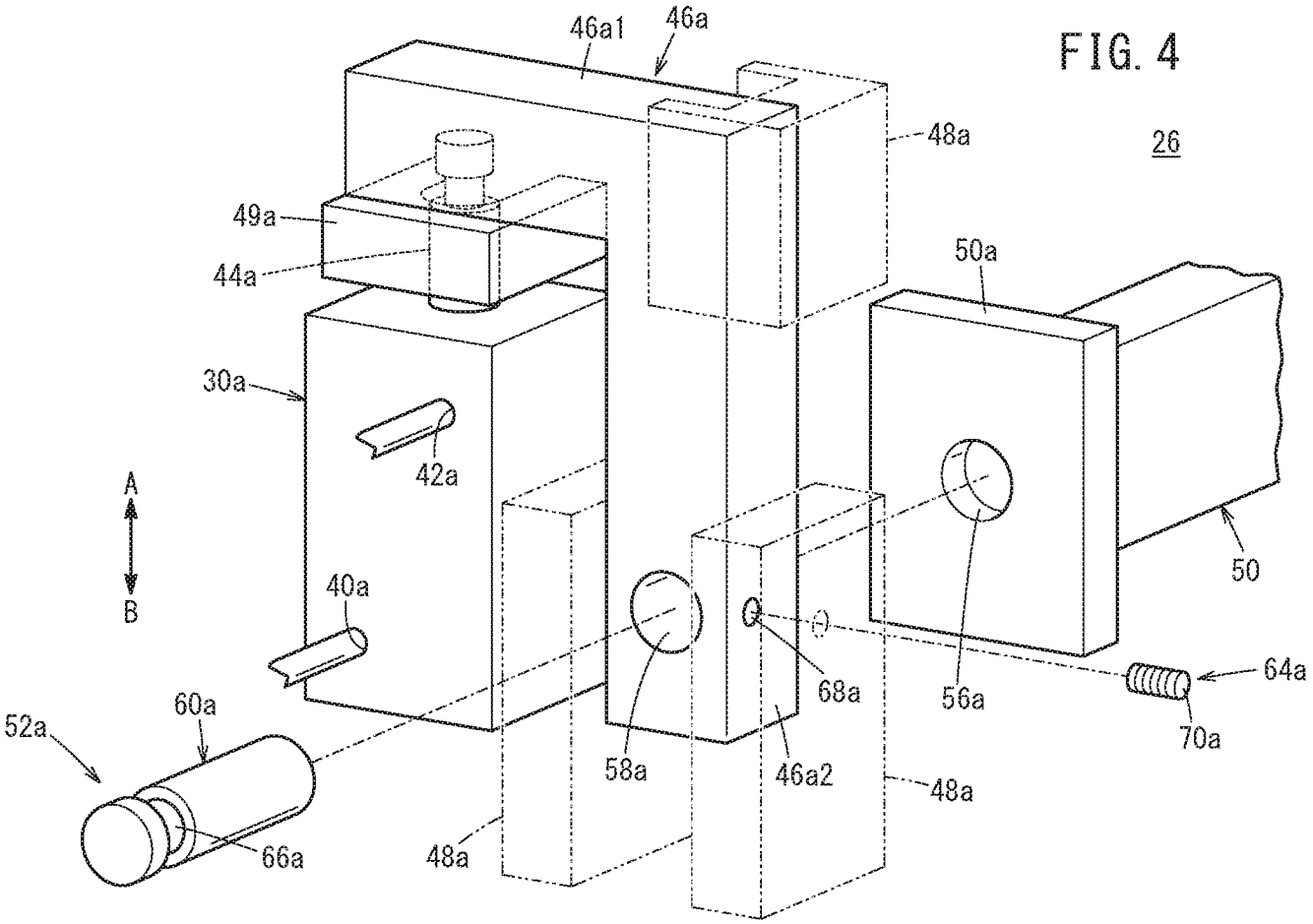
FIG. 4 is an exploded perspective view of a main part of the core pin movable structure.

As shown in FIGS. 2 to 4, the bent member 46*a* has a first side 46*a*1 and a second side 46*a*2 extending in directions intersecting each other. For example, the bent member 46*a* is formed in an L shape, the first side 46*a*1 extends in the horizontal direction, and the second side 46*a*2 extends in the vertical direction and is longer than the first side 46*a*1. In addition, the first side 46*a*1 and the second side 46*a*2 may be set to the same length.

The cylinder 30*a* is juxtaposed with the second side 46*a*2 and disposed to face the inner surface 46*a*1 (*in*) of the first side 46*a*1 (see FIG. 3). The rod 44*a* is connected to the inner surface 46*a*1 (*in*) of the first side 46*a*1. As shown in FIGS. 2 to 4, the bent member 46*a* is guided by a plurality of guide members 48*a* fixed to the cylinder mounting plate 28*a* and held so as to advance and retract in the vertical direction (the direction of the arrow A and the direction of the arrow B). Above the cylinder 30*a*, there is arranged a stopper 49*a* surrounding the rod 44*a* and abutting on the first side 46*a*1.

As shown in FIG. 2, the end portion 50*a* of the core pin holding member 50 is detachably connected to the second side 46*a*2 via a joint mechanism 52*a*. The core pin holding member 50 has a plate shape, and is disposed in the upper mold base 16 so as to extend in the horizontal direction. Both end portions 50*a*, 50*b* are adjacent to and oppose the cylinder mounting plates 28*a*, 28*b*, and can advance and retreat in the vertical direction. A plurality of core pins 54, which protrude into the cavity 18 and form a cast hole for attaching equipment such as an injector to the cast product, are attached to the core pin holding member 50.

Figure 5:
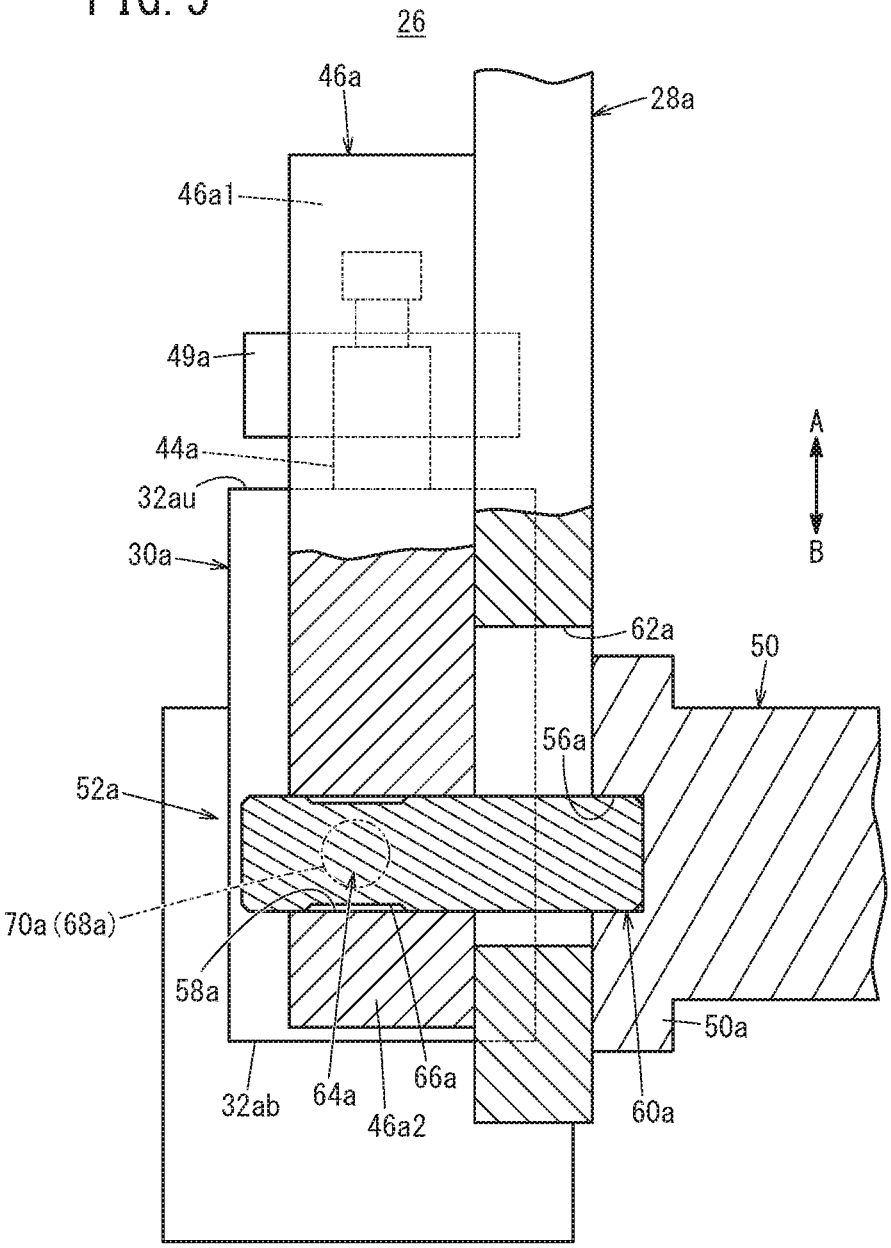
FIG. 5 is a cross-sectional view taken along the line V-V in FIG. 3 of the movable pin moving structure.

As shown in FIGS. 4 and 5, the joint mechanism 52*a* includes a first hole portion (first opening portion) 56*a* formed at one end portion 50*a* of the core pin holding member 50 from the end face side. On the lower side of the second side 46*a*2 of the bent member 46*a*, a second hole portion (second opening portion) 58*a* that can be arranged coaxially with the first hole portion 56*a* is formed. A joint pin 60*a* is inserted into both the first hole portion 56*a* and the second hole portion 58*a*, and an vertically elongated opening portion 62*a* is formed in the cylinder mounting plate 28*a* over a range in which the joint pin 60*a* is vertically movable.

The bent member 46*a* is provided with a restriction mechanism 64*a* for restrict the movement of the joint pin 60*a* in the axial direction. The restriction mechanism 64*a* has a circumferential groove 66*a* as an engaging groove (engaging recessed portion) formed on the outer peripheral surface of one end edge portion (outer side edge portion) of the joint pin 60*a*. A screw hole 68*a* is formed on a side surface of the second side 46*a*2 of the bent member 46*a* in a direction intersecting the axial direction of the second hole portion 58*a* (the axial direction of the joint pin 60*a*). A fixing screw member 70*a* screwed into the screw hole 68*a* is engaged with the circumferential groove 66*a* of the joint pin 60*a* and regulates the movement of the joint pin 60*a* in the axial direction.

The cylinder mounting plate 28*b* and the cylinder 30*b* are formed in the same manner as the cylinder mounting plate 28*a* and the cylinder 30*a*, and the same structural elements are denoted by the same reference numerals with "b" instead of "a", and a detailed description thereof will be omitted.

Operations of the casting device 10 thus configured will be described below.

As shown in FIG. 1, firstly, the sliding molds 22*a* to 22*d* held by the sliding mold base 14 move towards each other and are arranged to circle around the lower mold 20. On the other hand, the upper mold base 16 moves downward under the action of an actuator (not shown), and the upper mold 24 is positioned with respect to the lower mold 20 and the sliding molds 22*a* to 22*d*.

Therefore, the casting device 10 is clamped and a cavity 18 is formed in the casting device 10. At that time, a plurality of core pins 54 are arranged in the cavity 18.

Figure 6:
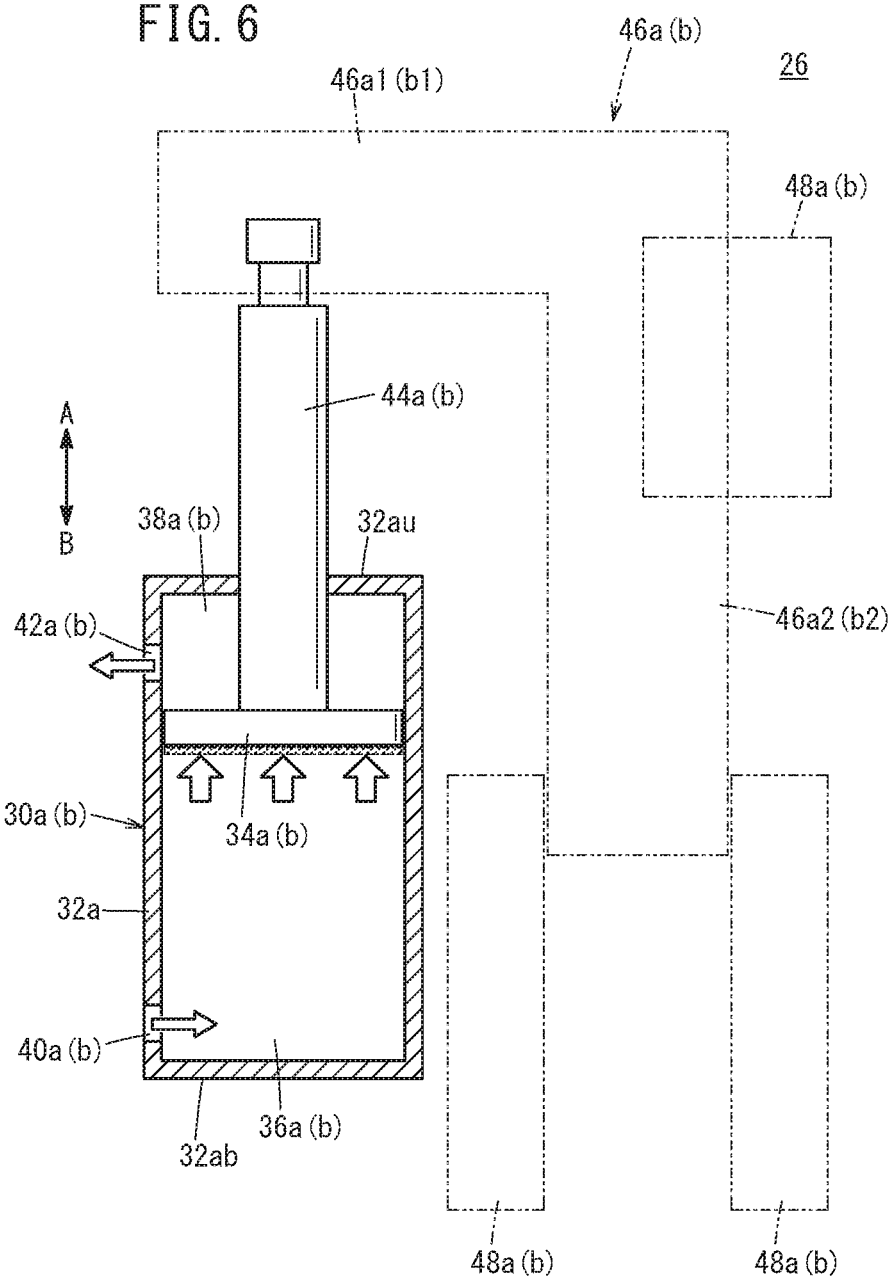
FIG. 6 is an explanatory view of a core-pin retracting state using a cylinder of the core pin movable structure.

Next, a molten metal is poured into the cavity 18. When the molten metal poured into the cavity 18 is cooled and solidified, the core pin 54 is retracted from the cavity 18 in a state where a desired mold clamping force is applied to the casting device 10. More specifically, as shown in FIG. 6, a hydraulic fluid is supplied from the first ports 40*a*, 40*b* of the cylinders 30*a*, 30*b* to the first pressure chambers 36*a*, 36*b*. Accordingly, the pistons 34*a*, 34*b* are moved upward (in the direction of arrow A) by receiving the hydraulic pressure, and the rods 44*a*, 44*b* connected to the pistons 34*a*, 34*b* move upward.

First sides 46*a*1, 46*b*1 of the bent members 46*a*, 46*b* are connected to the distal ends of the rods 44*a*, 44*b*, and the bent members 46*a*, 46*b* move upward under the guiding action of the guide member 48*a*. As shown in FIG. 2, the end portions 50*a*, 50*b* of the core pin holding member 50 are connected to the bent members 46*a*, 46*b* via the joint mechanisms 52*a*, 52*b*. Thereby, the core pin holding member 50 moves upward integrally with the plurality of core pins 54, and the plurality of core pins 54 are retracted from the cavity 18.

Further, as shown in FIG. 1, the sliding molds 22*a* to 22*d* are moved in directions away from each other to open the mold. Then, after the clamping force of the upper mold 24 is released, the upper mold 24 is raised integrally with the upper mold base 16. Here, a product solidified in the cavity 18 (a cast product) sticks to the upper mold 24, and this product is released from the upper mold 24.

Next, when casting different kinds of cast products, general-purpose parts of the casting device 10 are exchanged. In addition to the lower mold 20, the sliding molds 22*a* to 22*d* and the upper mold 24, the plurality of core pins 54 are exchanged as the general-purpose parts. When exchanging the core pins 54, the fixing screw member 70*a* of the restriction mechanism 64*a* is screwed in a direction to be detached from the screw hole 68*a* as shown in FIGS. 4 and 5.

Therefore, the distal end of the fixing screw member 70*a* is disengaged from the circumferential groove 66*a* of the joint pin 60*a*, and the joint pin 60*a* engages with the first hole portion 56*a* formed at one end portion 50*a* of at least the core pin holding member 50. On the other hand, also in the restriction mechanism 64*b*, the joint pin 60*b* is taken out from at least the first hole portion 56*b* formed in the other end portion 50*b* of the core pin holding member 50.

Therefore, since the holding function by the restriction mechanisms 64*a* and 64*b* is released, the core pin holding member 50 is taken out from the upper mold base 16. Next, a new core pin holding member 50 provided with a desired core pin 54 is prepared, and by performing an operation in the reverse order to that described, the core pin holding member 50 is attached to the upper mold base 16 via the restriction mechanisms 64*a*, 64*b*.

In this case, in the first embodiment, as shown in FIG. 3, the cylinder 30*a* is arranged in parallel with the second side 46*a*2 of the bent member 46*a* and is arranged to face the inner surface 46*a*1 (*in*) of the first side 46*a*1. The cylinder 30*a* advances and retracts the rod 44*a* connected to the first side 46*a*1 of the bent member 46*a* so that the core pin holding member 50 connected to the second side 46*a*2 of the bent member 46*a* moves within the cavity 18 back and forth.

Thereby, for example, as compared with a configuration in which the cylinder 30*a* is disposed in the vertically downward direction (toward the cavity 18), the rod 44*a* extends downward and is connected to the bent member 46*a*, the dimension in the stroke length direction is effectively shortened. For this reason, it is possible to make the entire facility compact easily, narrowing the occupied area so as to be applicable to any types of models (versatility).

Moreover, the cylinder 30*a* is offset from the joint mechanism 52*a*. That is, as shown in FIG. 3, the point of effort P1 and the point of load P2 of the cylinder 30*a* are not arranged coaxially. Therefore, in a state in which the cylinder 30*a* is attached, the core pin holding member 50 and the core pin 54 can be attached and detached. Thereby, it is possible to reliably advance and retreat the core pin 54 with a compact and economical structure and effectively simplify the exchange operation of the core pin 54.

As shown in FIGS. 4 and 5, the joint mechanism 52*a* includes a first hole portion 56*a* formed in the end portion 50*a* of the pin-extraction pin holding member 50 and a second hole portion 58*a* formed in the second side 46*a*2 of the bent member 46*a*. A joint pin 60*a* is inserted into both the first hole portion 56*a* and the second hole portion 58*a*. Therefore, the attaching and detaching operation of the core pin holding member 50 by the joint mechanism 52*a* is performed easily and quickly.

Further, the rod of 44*a* the cylinder 30*a* protrudes upward from the end portion 32*au* on the opposite side to the end portion 32*ab* on the leading end side in the mold clamping direction toward the first side 46*a*1. Therefore, as shown in FIG. 6, when hydraulic fluid is supplied from the first port 40*a* of the cylinder 30*a* to the first pressure chamber 36*a*, hydraulic pressure can be received by the entire surface of the piston 34*a*. This makes it possible to maximize the thrust of the cylinder 30*a* when demolding the core pin 54.

Figure 7:
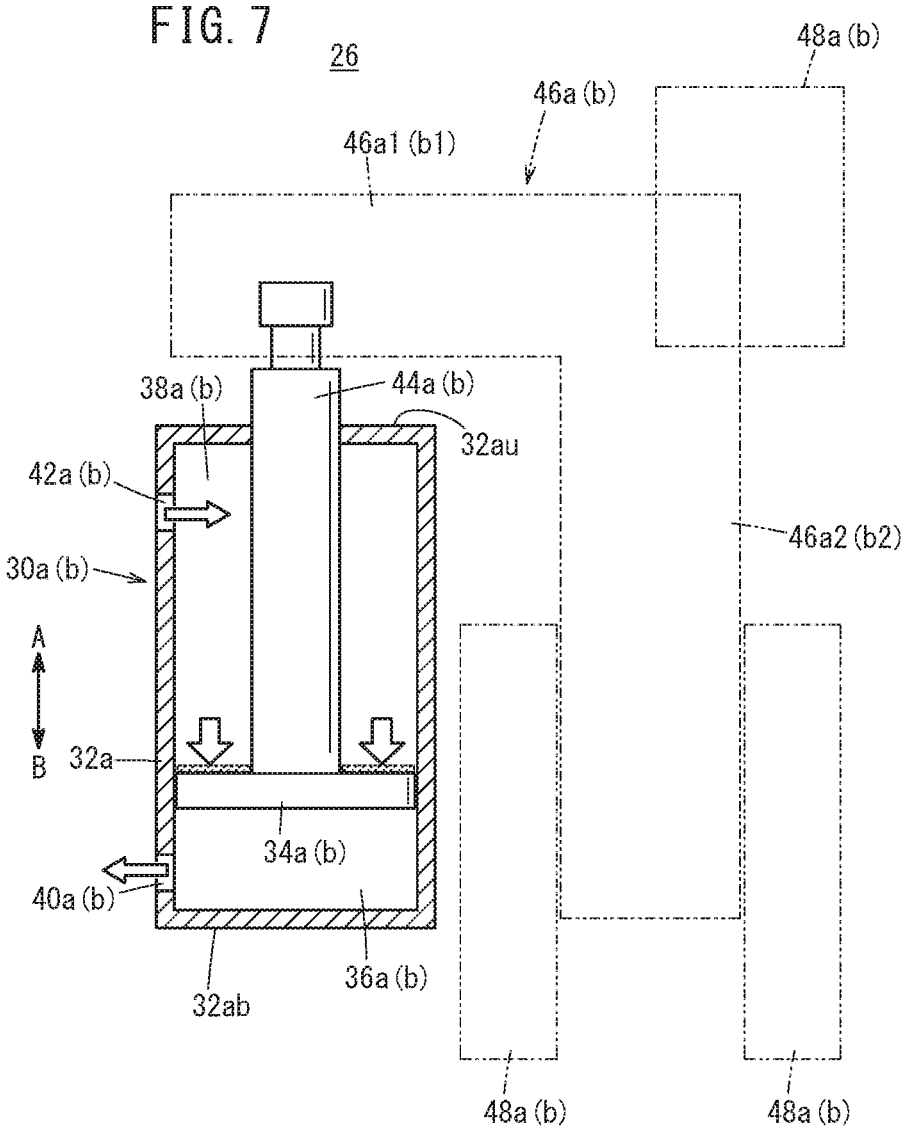
FIG. 7 is an explanatory view of a core-pin insertion state using the cylinder.

On the other hand, as shown in FIG. 7, when inserting the core pin 54 into the cavity 18, hydraulic fluid is supplied from the second port 42*a* of the cylinder 30*a* to the second pressure chamber 38*a*. In the second pressure chamber 38*a*, the piston 34*a* receives oil pressure in an area obtained by subtracting the cross-sectional area of the rod 44*a* from the entire area. Therefore, the thrust of the cylinder 30*a* is reduced, and loads and damage to the molds such as the sliding molds 22*a* to 22*d*, for example, at the time of inserting the core pin 54 can be satisfactorily suppressed.

Furthermore, as shown in FIGS. 4 and 5, the bent member 46*a* is provided with a restriction mechanism 64*a* for regulating the movement of the joint pin 60*a* in the axial direction. In the restriction mechanism 64*a*, the fixing screw member 70*a* screwed into the screw hole 68*a* is engaged with the circumferential groove 66*a* of the joint pin 60*a*, whereby the movement of the joint pin 60*a* in the axial direction is restricted. Therefore, it is possible to reliably prevent unnecessary detachment of the joint pin 60*a* with a simple structure.

The cylinder 30*b* side (the cylinder mounting plate 28*b* side) has the same effect as the cylinder 30*a* side (the cylinder mounting plate 28*a* side).

Further, in the first embodiment, the cylinders 30*a*, 30*b* are fixed and the bent members 46*a*, 46*b* are used, but the invention is not limited thereto. For example, upon changing the model of a cast product, the attachment angle of the cylinders 30*a*, 30*b* may be changeable. On the other hand, the bent members 46*a*, 46*b* may be configured so that the angle can be adjusted from a right angle shape to an acute angle shape, an obtuse angle shape, or the like at the time of changing the model of a cast product.

Figure 8:
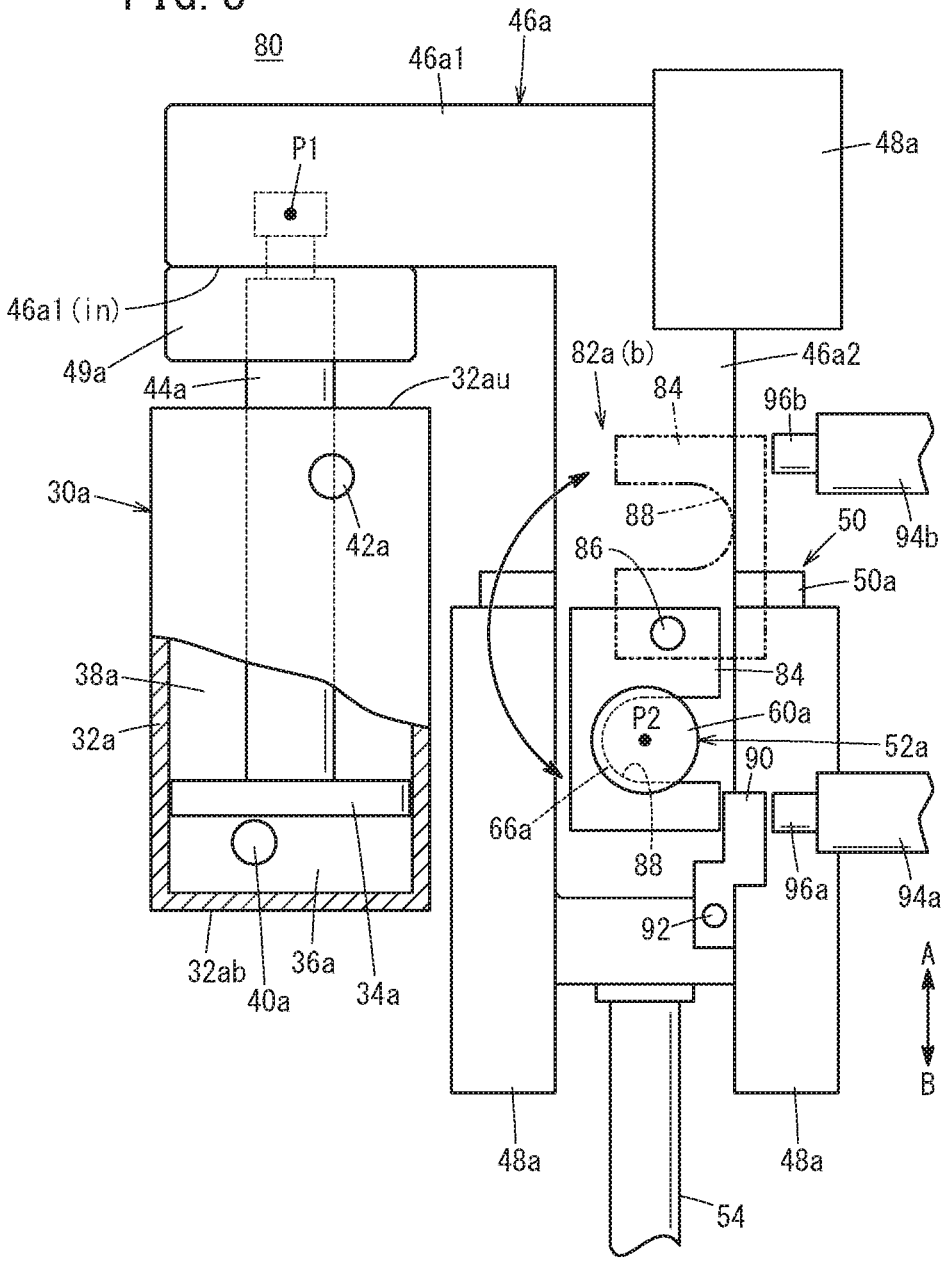
FIG. 8 is a front view of a casting device according to a second embodiment of the present invention.

FIG. 8 is a front view of the casting device 80 according to the second embodiment of the present invention. The same components as those of the casting device 10 according to the first embodiment are denoted by the same reference numerals, and a detailed description thereof will be omitted.

The casting device 80 includes restriction mechanisms 82*a*, 82*b* in place of the restriction mechanisms 64*a*, 64*b*. The restriction mechanism 82*b* is constructed in conformity with the restriction mechanism 82*a*, so the restriction mechanism 82*a* will be described below, and the explanation of the restriction mechanism 82*b* will be omitted. The restriction mechanism 82*a* includes a locking plate 84 that engages with a circumferential groove 66*a* as an engaging recessed portion (engaging groove) formed in the joint pin 60*a*, and the locking plate 84 is engaged with the locking plate 84 with the bolt 86 as a fulcrum.

The circumferential groove 66*a* of the joint pin 60*a* is exposed to the outside from the second side 46*a*2 of the bent member 46*a* and the curved concave portion 88 to be engaged with the circumferential groove 66*a* is formed in the locking plate 84. At a position where the locking plate 84 is engaged with the circumferential groove 66*a* (the portion in a solid line in FIG. 8), the pressing member 90 is disposed so as to be capable of swinging with the bolt 92 as a fulcrum opposed to the locking plate 84.

A lower cylinder (actuator) 94*a* is disposed to face the pressing member 90, and a rod 96*a* protrudes from the lower cylinder 94*a* toward the pressing member 90. Above the upper side of the lower cylinder 94*a*, in a state in which the locking plate 84 is disengaged from the circumferential groove 66*a* and disposed in the upper position (the position indicated by the two-dot chain line in FIG. 8), the upper cylinder (actuator) 94*b* is disposed to face the locking plate 84. The rod 96*b* projects from the upper cylinder 94*b* toward the locking plate 84.

In the second embodiment configured as described above, when the lower cylinder 94*a* of the restriction mechanism 82*a* is driven to protrude the rod 96*a*, the rod 96*a* abuts against the pressing member 90. The pressing member 90 swings toward the locking plate 84 with the bolt 92 as a fulcrum, and the locking plate 84 swings upward with the bolt 86 as a fulcrum. For this reason, the locking plate 84 is disposed at the position indicated by the two-dot chain line in FIG. 8 and is disengaged from the circumferential groove 66*a* so that the joint pin 60*a* can be taken out.

On the other hand, when the upper cylinder 94*b* is driven and the rod 96*b* protrudes toward the locking plate 84 at the upper position, the locking plate 84 sways downward under the pressing action of the rod 96*b*. Therefore, the locking plate 84 is engaged with the circumferential groove 66*a* and can hold the joint pin 60*a*.

In the second embodiment, the upper cylinder 94*b* and the lower cylinder 94*a* are provided as the actuators so as to swing the locking plate 84, but the present invention is not limited thereto. For example, it is also possible to dispense with an actuator and to swing the locking plate 84 with the operator's fingers.

Figure 9:
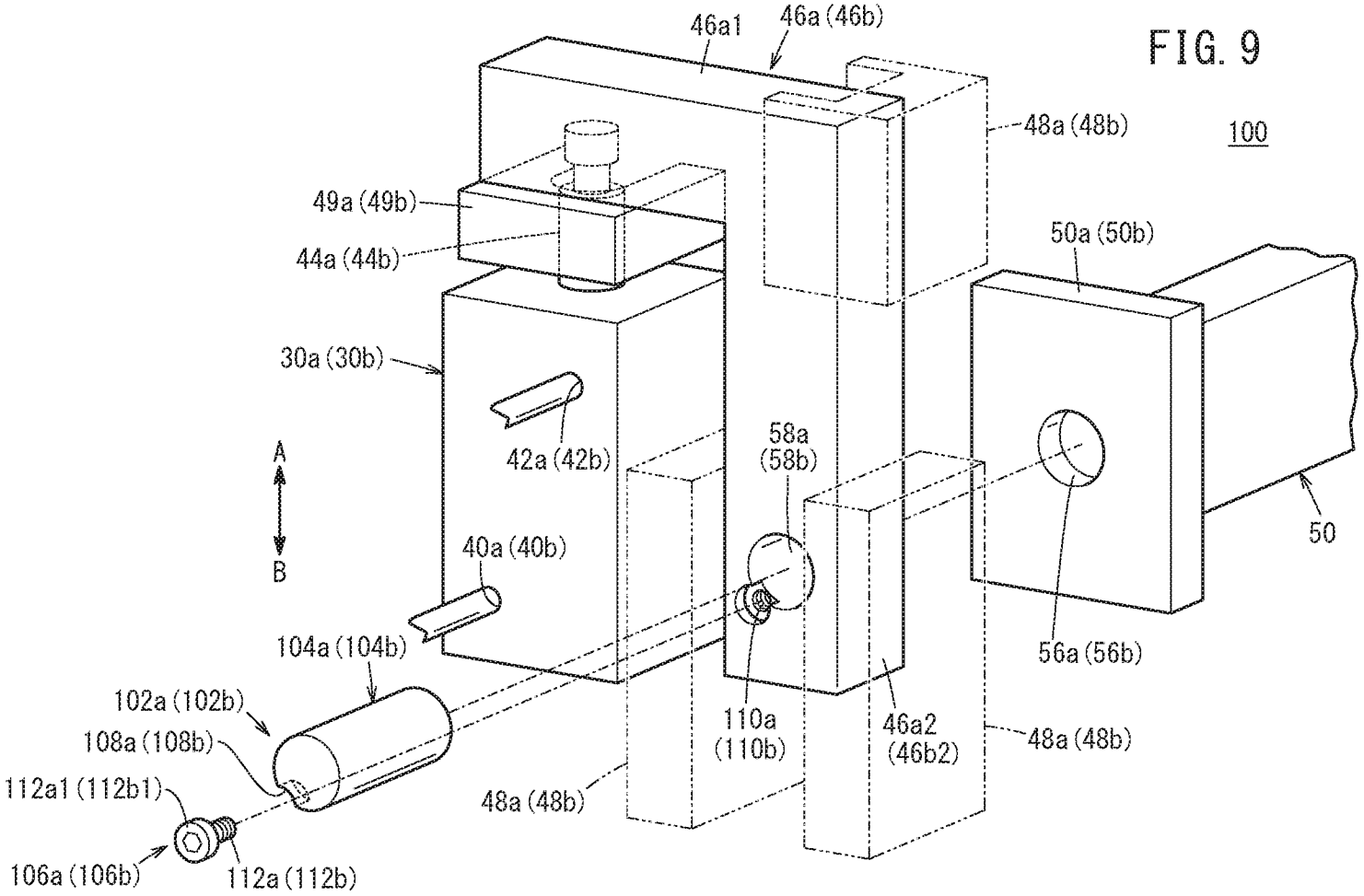
FIG. 9 is an exploded perspective view of a main part of a casting device according to a third embodiment of the present invention.

FIG. 9 is an exploded perspective view of a main part of a casting device 100 according to a third embodiment of the present invention. The same components as those of the casting device 10 according to the first embodiment are denoted by the same reference numerals, and a detailed description thereof will be omitted.

A casting device 100 comprises joint mechanisms 102*a*, 102*b*. Since the joint mechanism 102*b* is configured similarly to the joint mechanism 102*a*, the joint mechanism 102*a* will be described below, and the description of the joint mechanism 102*b* will be omitted.

As shown in FIG. 9, the joint mechanism 102*a* includes a first hole portion (first opening portion) 56*a* formed at one end portion 50*a* of the core pin holding member 50. On the other hand, on the lower side of the second side 46*a*2 of the bent member 46*a*, a second hole portion (second opening portion) 58*a* that can be disposed coaxially with the first hole portion 56*a* is formed. A joint pin 104*a* is inserted into both the first hole portion 56*a* and the second hole portion 58*a*.

Figure 10:
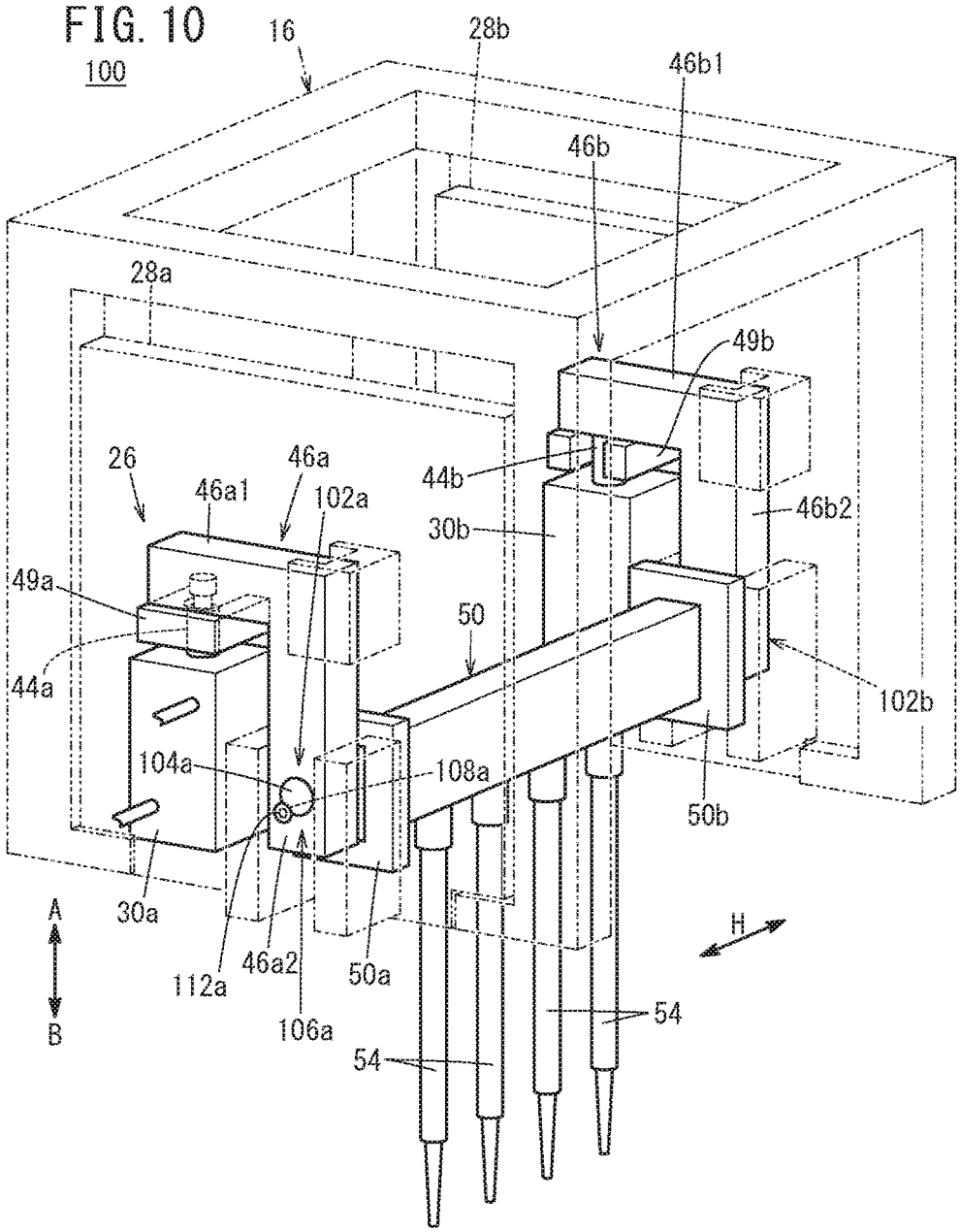
FIG. 10 is a perspective view showing a main part of the casting device of FIG. 9.

The bent member 46*a* is provided with a restriction mechanism 106*a* for regulating the movement of the joint pin 104*a* in the axial direction. The restriction mechanism 106*a* includes a step portion 108*a* as an engaging recessed portion formed in one end portion including one bottom surface of the joint pin 104*a*. Further, a screw hole 110*a* whose axial direction coincides with the axial direction of the second hole portion 58*a* (axial direction of the joint pin 104*a*) is formed on the end face of the second side 46*a*2 of the bent member 46*a*. The lower end surface of the head portion 112*a*1 of the fixing screw member 112*a* screwed into the screw hole 110*a* is seated on the bottom surface of the step portion 108*a* as shown in FIG. 10. Along with this seating, movement of the joint pin 104*a* in the axial direction is regulated by the fixing screw member 112*a*.

In the third embodiment configured as described above, when casting different kinds of cast products, general-purpose parts such as the lower mold 20, the sliding molds 22*a* to 22*d*, the upper mold 24, the core pin 54 and the like are exchanged. For exchanging the core pin 54, as shown in FIG. 9, the fixing screw member 112*a* of the restriction mechanism 106*a* is screwed in a direction in which it is separated from the screw hole 110*a*. That is, the lower end surface of the head portion 112*a*1 of the fixing screw member 112*a* separates from the bottom surface of the step portion 108*a*.

Due to this separation, the joint pin 104*a* is released from the restraint of the fixing screw member 112*a*. Therefore, it is possible to take out the joint pin 104*a* from the first hole portion 56*a*. Similarly, in the restriction mechanism 106*b*, the joint pin 104*b* can be taken out from the first hole portion 56*b* formed in the other end portion 50*b* of the core pin holding member 50.

That is, the holding function with respect to the core pin holding member 50 by the restriction mechanisms 106*a*, 106*b* is released, and the core pin holding member 50 is taken out from the upper mold base 16. Thereafter, a new core pin holding member 50 provided with a desired core pin 54 is prepared, and by performing an operation in the reverse order to that described above, the core pin holding member 50 is attached to the upper mold base 16 via the restriction mechanisms 106*a* and 106*b*.

As described above, also in the third embodiment, it is possible to effectively simplify the replacement operation of the core pin 54.

What is claim is:

1. A casting device comprising a core pin capable of advancing and retracting in a product cavity, wherein a molten metal is poured into the product cavity to obtain a cast product with a cast hole, the casting device comprises a pair of cylinders, a core pin holding member to which the core pin is attached, and a pair of bent members having a first side and a second side respectively extending in directions intersecting with each other, the cylinder is arranged parallel to the second side, and is arranged to face an inner surface of the first side, and a rod projecting from the cylinder is connected to the inner surface of the first side, and the second side is detachably connected to an end portion of the core pin holding member via a joint mechanism.

2. The casting device according to claim 1, wherein the joint mechanism comprises a first opening formed at an end portion of the core pin holding member, a second opening formed in the second side, and a joint pin to be inserted into both the first opening and the second opening.

3. The casting device according to claim 2, further comprising a restriction mechanism provided on the bent member and regulating movement of the joint pin in an axial direction, wherein the restriction mechanism includes a screw hole formed in the second side of the bent member in a direction intersecting the axial direction of the joint pin, a fixing screw member screwed into the screw hole, and an engaging recessed portion formed in the joint pin, wherein the fixing screw member screwed into the screw hole is engaged with the engaging recessed portion so as to restrict movement in the axial direction of the joint pin.

4. The casting device according to claim 3, wherein the engaging recessed portion is an engaging groove formed so as to surround a sidewall of the joint pin.

5. The casting device according to claim 3, wherein the engaging recessed portion is a step formed at an end of the joint pin.

6. The casting device according to claim 2, further comprising a restriction mechanism provided on the bent member and regulating movement of the joint pin in the axial direction, wherein the restriction mechanism includes engaging recessed portions formed on an outer circumferential surface of the joint pin and a swingable locking plate engaging with the engaging recessed portion.

7. The casting device according to claim 1, wherein the rod of the cylinder projects toward the first side, from an end opposite to an end on a leading end side in a mold clamping direction.

8. The casting device according to claim 1, wherein the bent member has an L shape in which the first side is shorter than the second side.

* * * * *